US008651916B2

(12) United States Patent
Irmler et al.

(10) Patent No.: US 8,651,916 B2
(45) Date of Patent: Feb. 18, 2014

(54) SYSTEM AND METHOD FOR GENERATING REALISTIC EYES

(75) Inventors: Holger Irmler, Studio City, CA (US); Alfredo M. Ayala, West Covina, CA (US); Frank Mezzatesta, Glendale, CA (US); Gary W. Schnuckle, Altadena, CA (US); Lanny S. Smoot, Thousand Oaks, CA (US); Philip J. Jackson, Glendale, CA (US); Ronit Slyper, Pittsburgh, PA (US)

(73) Assignee: Disney Enterprises, Inc., Burbank, CA (US)

( * ) Notice: Subject to any disclaimer, the term of this patent is extended or adjusted under 35 U.S.C. 154(b) by 523 days.

(21) Appl. No.: 12/689,034

(22) Filed: Jan. 18, 2010

(65) Prior Publication Data

US 2011/0177753 A1 Jul. 21, 2011

(51) Int. Cl.
*A63H 3/38* (2006.01)

(52) U.S. Cl.
USPC ..... 446/392; 446/219; 446/389

(58) Field of Classification Search
USPC ..... 446/389, 392, 219; 434/271
See application file for complete search history.

(56) References Cited

U.S. PATENT DOCUMENTS

| | | | | |
|---|---|---|---|---|
| 2,391,045 | A * | 12/1945 | Tillyer | 351/159.52 |
| 4,305,223 | A * | 12/1981 | Ho | 446/392 |
| 4,978,216 | A | 12/1990 | Liljegren et al. | |
| 5,000,714 | A * | 3/1991 | Su | 446/392 |
| 5,004,443 | A * | 4/1991 | Su | 446/392 |
| 5,473,474 | A * | 12/1995 | Powell | 359/725 |
| 6,391,057 | B1 * | 5/2002 | Schleipman et al. | 623/6.64 |
| 6,576,013 | B1 * | 6/2003 | Budman et al. | 623/6.64 |
| 6,623,428 | B2 * | 9/2003 | Miller et al. | 600/300 |
| 6,811,260 | B2 * | 11/2004 | Yamakaji | 351/159.02 |
| 7,066,628 | B2 * | 6/2006 | Allen | 362/267 |
| 7,443,608 | B2 * | 10/2008 | Dillon | 359/707 |
| 2008/0106489 | A1 * | 5/2008 | Brown et al. | 345/9 |
| 2008/0139082 | A1 | 6/2008 | Schnuckle | |
| 2009/0292614 | A1 | 11/2009 | Reichow et al. | |
| 2010/0015885 | A1 * | 1/2010 | Chang | 446/392 |
| 2010/0136880 | A1 * | 6/2010 | Liu | 446/392 |
| 2012/0229877 | A1 * | 9/2012 | Spatscheck et al. | 359/196.1 |

* cited by examiner

*Primary Examiner* — Gene Kim
*Assistant Examiner* — Joseph B Baldori
(74) *Attorney, Agent, or Firm* — Patterson & Sheridan LLP

(57) ABSTRACT

Realistic electronically controlled eyes for a figure such as a doll, toy, animatronic being, robot, etc., are provided by displaying a sequence of images simulating eye movement on an electronic display screen mounted to a portion of the figure. A convex lens, which serves to simulate the figure's eye, is mounted substantially in contact with a surface of the display screen system from which the light defining the sequence of images is emitted. To an observer looking at the convex surface of the lens, the lens appears as an eye characterized by realistic eye movement.

11 Claims, 5 Drawing Sheets

SYSTEM AND METHOD FOR GENERATING REALISTIC EYES

BACKGROUND

Artificial eyes are used in dolls, toy creatures, animatronic beings, life-like robots, etc., collectively referred to as "figures" in this patent specification ("herein"). Animatronic humans, animals, cartoon characters, or other figures that entertain or inform theme park guests may include realistic artificial eyes that can be electronically animated, i.e., made to appear to move in a life-like manner For example, electronically controlled actuators can move an artificial eyeball about one or more axes, open and close an eyelid, and dilate and constrict a pupil.

The face of a figure, including the eyes and other facial features, can be animated by projecting an image onto a surface that is contoured to simulate a face. The image can be projected onto such a surface from either the front or the rear of the surface. In a rear-projection system, a projector can be concealed inside a hollow head of the figure and project an image onto the inside or rear surface of a translucent face. Viewed from the front of the face, a rear-projected moving image can provide the appearance of movement of facial features, including the eyes.

SUMMARY

Embodiments of the present invention relate to a system and method for generating realistic electronically controlled eyes for a figure. An exemplary system can include a display screen system mounted to a body portion of a figure such as a doll, toy, animatronic being, robot, etc. A convex lens, which serves to simulate the figure's eye, is mounted substantially in contact with a surface of the display screen system. In an exemplary method of operation, eye movement is simulated by the display screen system displaying a sequence of images. To the observer looking at the convex surface of the lens, the lens appears as an eye characterized by realistic eye movement.

Other systems, methods, features, and advantages of the invention will be or become apparent to one of skill in the art to which the invention relates upon examination of the following figures and detailed description. All such additional systems, methods, features, and advantages are encompassed by this description and the accompanying claims.

BRIEF DESCRIPTION OF THE FIGURES

The invention can be better understood with reference to the following figures. The elements shown in the figures are not necessarily to scale, emphasis instead being placed upon clearly illustrating the principles of the invention. Also, in the figures like reference numerals designate corresponding elements throughout the different views.

DETAILED DESCRIPTION

Figure 1:
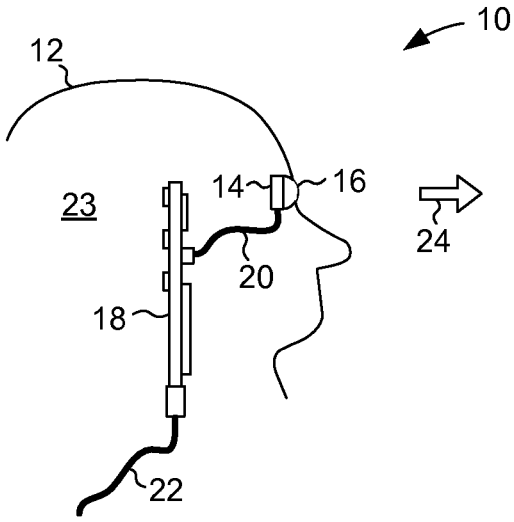
FIG. 1 is a side view of a figure having an artificial eye system, in accordance with an exemplary embodiment of the invention.

As illustrated in FIG. 1, in an illustrative or exemplary embodiment of the invention, a figure having an artificial, electronically controlled eye system 10 includes a figure body portion 12, a display screen system 14, a lens 16, a controller 18, a connection 20 coupling controller 18 to display screen system 14, and another connection 22 coupling controller 18 to external systems (not shown for purposes of clarity). (In FIG. 1, figure body portion 12 is shown in cross-section.) The figure to which figure body portion 12 relates can be, for example, a doll, toy, animatronic figure, robot, costume, etc., resembling a human being, animal, cartoon character, fanciful creature, or anything else that includes one or more eyes. Figure body portion 12 can be any portion or region of the figure that bears an eye. For example, figure body portion 12 can be a structure resembling a person's head or a portion thereof. In other embodiments, the figure body portion can be a structure resembling an animal's head or portion thereof, or even an eye stalk on a lobster, snail or fanciful creature.

Although controller 18 is shown located within a void or cavity 23 in figure body portion 12 for purposes of illustration, in other embodiments the controller or similar device can be located in other regions of a figure or body portion thereof, or located externally to and remotely from the figure or body portion thereof. For example, in an animatronic figure, the controller can be located with or integrated with animatronic controllers and connected by a cable or other suitable connection to display screen system 14. In the exemplary embodiment, connection 22 is included for purposes of programming controller 18, diagnosing problems with controller 18, or other purposes, as described in further detail below.

Figure 2:
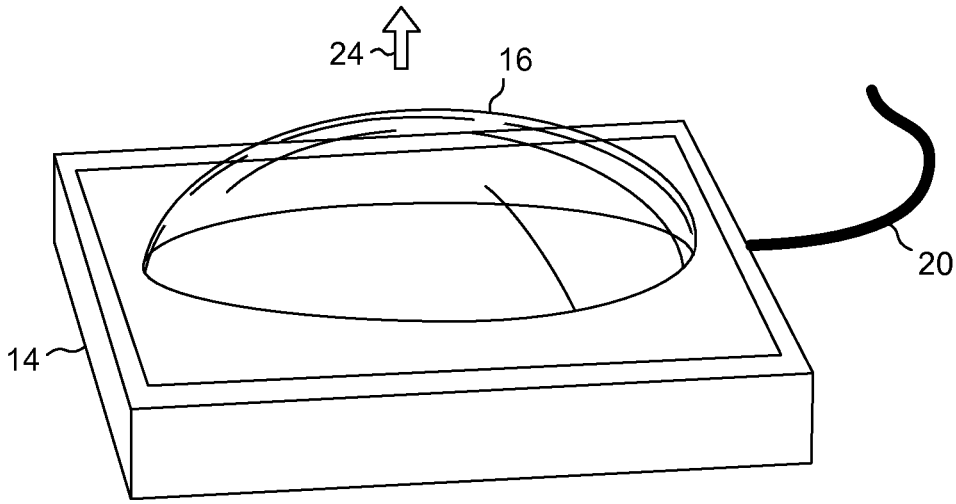
FIG. 2 is a perspective view of a display screen system and lens of the artificial eye system of FIG. 1, in accordance with an exemplary embodiment of the invention.
Figure 3:
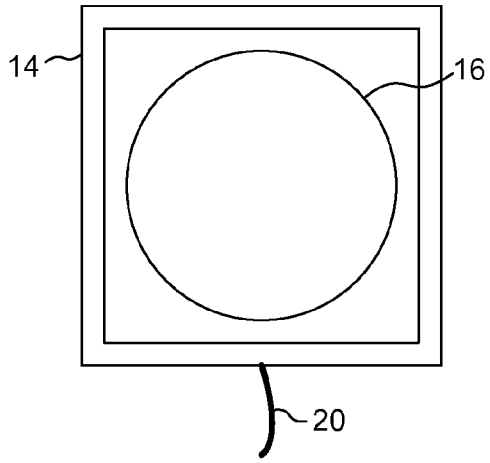
FIG. 3 is a top plan view of the display screen system and lens of FIG. 2.
Figure 4:
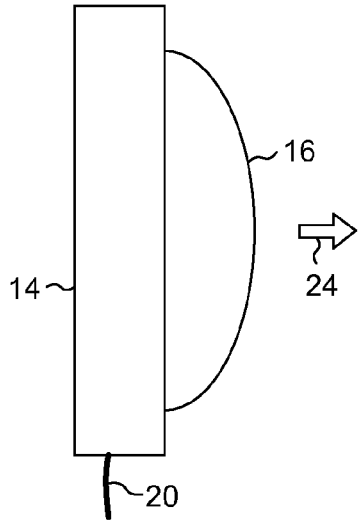
FIG. 4 is a side elevation view of the display screen system and lens of FIG. 2.

As illustrated in FIGS. 2-4, display screen system 14 can comprise a generally flat, rectangular display screen of the type and compact size commonly used in some cellular telephones, digital cameras, or similar hand-held electronic devices. Although various types of display screens may be suitable, an organic light-emitting diode (OLED) display screen has been found to exhibit a high contrast ratio and wide viewing angle that can result in an extremely realistic eye effect. Also, athough OLED and similar transmissive display screens that emit light have been found to be suitable, reflective and transflective display screens that operate at least partly using ambient light are also contemplated.

As further illustrated in FIGS. 2-4, lens 16 has a convex side so as to evoke the shape of an eye. A flat side of lens 16, opposing the convex side, is mounted on the surface of display screen system 14 from which light is emitted during operation. Lens 16 can be attached to the surface of display screen system 14 with a suitable transparent adhesive, such as an index-matching adhesive. An index-matching adhesive can promote a wider field of view from the perspective of an observer looking at lens 16. Alternatively, in other embodiments lens 16 can be held in place against the surface of display screen system 14 with a bezel, or mounted in any other suitable manner Although in the exemplary embodiment shown in FIGS. 2-4 the surface of display screen system 14 on which lens 16 is mounted is flat, in other embodiments the surface can have any other suitable shape. For example, in other embodiments the surface on which the lens is mounted can protrude or be contoured. Also, although in this embodiment lens 16 is in contact with the surface of display screen system 14, and in other embodiments the lens and surface are joined by an adhesive, in still other embodiments the lens and surface may be separated by a small space or gap (i.e., substantially in contact with each other), with the lens and display screen system retained together within a frame or module.

The convex side of lens 16 can have any suitable shape. For example, it can be hemispherical. However, the convex shape need not be rounded or otherwise uniform and can have contours, surface features, mounting flanges or other characteristics that help provide the appearance of an eye or serve another function. Lens 16 can be clear and transparent as in the exemplary embodiment or tinted. In other embodiments, lens 16 can include one or more opaque areas. Although in the exemplary embodiment lens 16 is made of a homogeneous material such as acrylic, in other embodiments the lens can comprise multiple materials or multiple portions that can be made of different materials.

Display screen system 14 and the attached lens 16 are mounted to figure body portion 12 by mounting them on or in figure body portion 12 in a position and orientation resembling the position and orientation of an eye. In operation, light emitted from display screen system 14 passes through lens 16 in the direction of the outwardly facing arrow 24, i.e., in a direction away from the outer surface of figure body portion 12.

Figure 5:
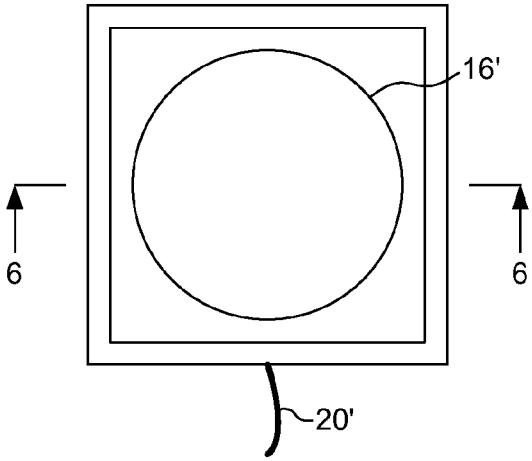
FIG. 5 is similar to FIG. 3, illustrating another exemplary display screen system and lens.
Figure 6:
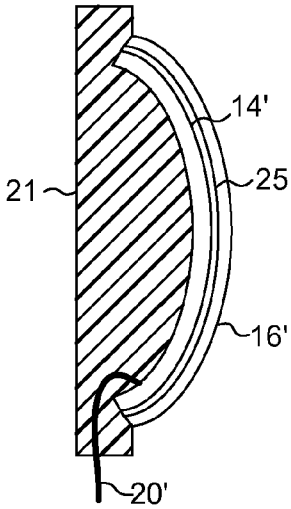
FIG. 6 is a sectional view taken on line 6-6 of FIG. 5.

As illustrated in FIGS. 5-6, in an alternative embodiment a display screen system comprises a flexible, sheet-like display 14' mounted on a convex portion of a support structure 21. Such flexible displays are well known to persons skilled in the art. Some flexible displays utilize thin-film transistor arrays or OLEDs on a flexible polymer substrate. Others utilize nano-particles. Any such flexible display that can be deformed or flexed to conform to a convex surface is suitable.

A meniscus lens 16', i.e., a thin lens having a convex outer surface and correspondingly concave inner surface, can be mounted over display 14'. Meniscus lens 16' can help protect the surface of display 14'. An index-matching adhesive 25 can be used to attach lens 16' to display 14', thereby promoting a wider field of view.

Figure 7:
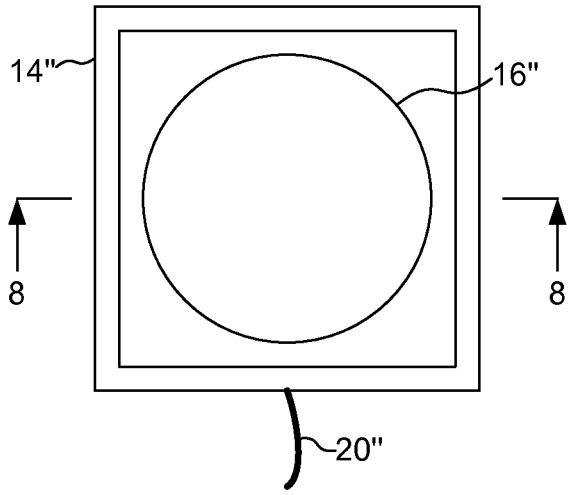
FIG. 7 is similar to FIGS. 3 and 5, illustrating still another exemplary display screen system and lens.
Figure 8:
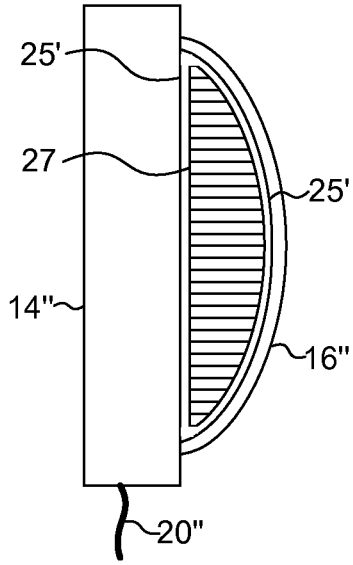
FIG. 8 is similar to FIG. 6, providing a sectional view of the light conduit and lens taken on line 8-8 of FIG. 7.

As illustrated in FIGS. 7-8, in another alternative embodiment a fiber-optic light conduit 27 couples a convex lens 16" to a display screen system 14". Suitable light conduits, comprising a coherent bundle of optical fibers, are well known in the art. Lens 16" can be a meniscus lens of the type described above with regard to FIGS. 5-6. The distal end of light conduit 27 is provided with a rounded or convex shape that matches the shape of the concave interior surface of lens 16". An index-matching adhesive 25' can be used to attach lens 16" to the distal end of light conduit 27. Index-matching adhesive 25' can also be used to attach a proximal end of light conduit 27 to the flat surface of display screen system 14". The combination of a meniscus lens 16" and index-matching adhesive 25' can promote the illusion of the image being located on or near the outer surface of lens 16". In addition, the smooth outer surface of lens 16" simulates the smooth, slightly reflective surface of an eye. Thus, an image of an eye on or near the outer surface of lens 16" can very realistically simulate an eye.

Figure 9:
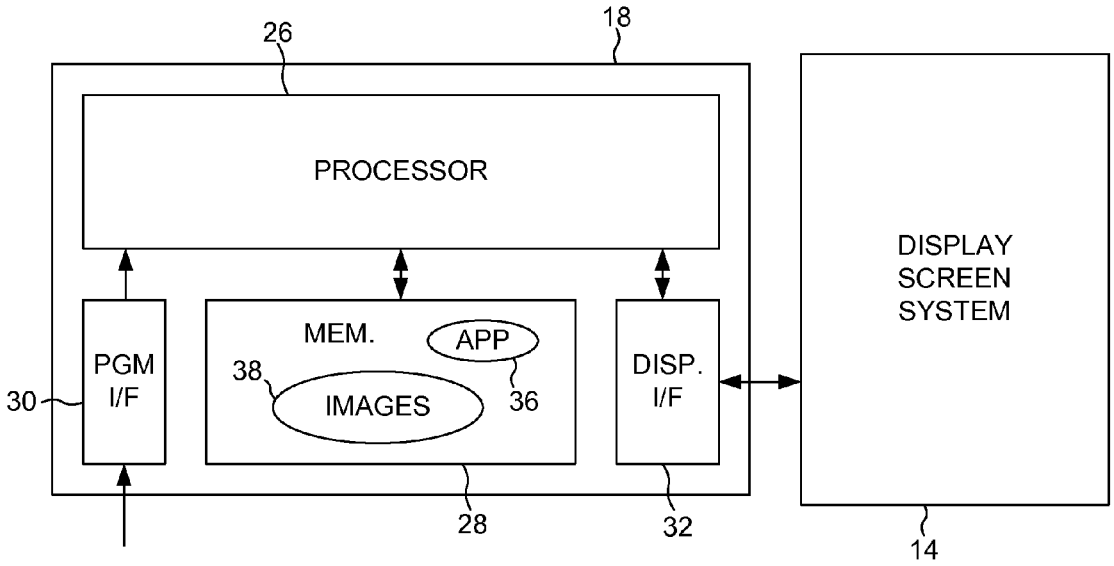
FIG. 9 is a block diagram of the artificial eye system of FIG. 1.

As illustrated in FIG. 9, in the exemplary embodiment controller 18 can include a processor 26, a memory 28, a programming interface 30, and a display interface 32. Display interface 32 provides data communication between controller 18 and display screen system 14.

An example of a suitable display screen system 14 is a product available from 4D Systems Pty. Ltd. of Sydney, Australia under the product name "μOLED-128-G1 Intelligent OLED Display Module." This product combines a 1.5 inch square, passive matrix, 128×128 pixel OLED display screen with a graphics processor on a small circuit card. In the exemplary embodiment, processor 26 can comprise such a graphics processor. A micro-SD (Secure Digital) flash memory card interface (not shown), also available from 4D Systems and other sources, optionally can be connected to the circuit card and used to store application software 36 and image data 38 for use by the graphics processor. Such data elements can be uploaded from a personal computer to the micro-SD card or the graphics processor. Although such data elements are shown for purposes of illustration as stored in memory 28, persons skilled in the art to which the invention relates understand that all such data elements may not reside in memory 28 in their entireties or simultaneously during operation but rather can be loaded in portions (e.g., files, modules, bytes, etc.) on an as-needed basis from one or more other sources. For example, memory 28 can include several elements, such as a volatile working memory portion and a non-volatile flash memory portion, and data stored in the flash memory portion can be loaded as needed into the working memory portion. Alternatively, data can be loaded from an external source, such as a computer, network, or other system (not shown) that communicates with display screen system 14 via programming interface 30.

In operation, processor 26, operating at least in part under the control of application software 36, retrieves image data 38 from memory 28 and causes the images represented by that data to be displayed on display screen system 14 by providing corresponding control signals to display screen system 14. Persons skilled in the art will readily be capable of providing suitable data that, when rendered as a sequence of displayed images, simulates an eye and its movement. For example, a living eye of a human or animal can be digitally photographed, and the captured images stored as image data 38. Alternatively, artwork depicting an eye in various positions or states can be digitized and stored as image data 38. Although the data or signals represent a sequence of images, the actual image data can be provided in any suitable format, such as a video-scan format, and need not consist of individual data blocks or frames corresponding to the display resolution (e.g., 128×128 pixel data blocks).

Processor 26 can cause the images to be displayed in any suitable order or manner, such as in synchronization with, or otherwise in response to, signals or events. For example, display screen system 14 can receive signals from an animatronic controller (not shown) via programming interface 30 or an additional interface (not shown), indicating that the figure or portion thereof has changed orientation or state, and cause processor 26 to simulate movement of an eye in a manner that corresponds to the changed orientation or state. For example, when an animatronic figure's head turns to the left, the eyes can be made to appear to move correspondingly to the right to provide the appearance of the figure's gaze being fixed upon an object. Other examples of synchronized or coordinated eye movement include blinking at times that are synchronized with a soundtrack simulating the figure's speech or noises, as the eyelid can be displayed as well as other portions of the eye.

Figure 10:
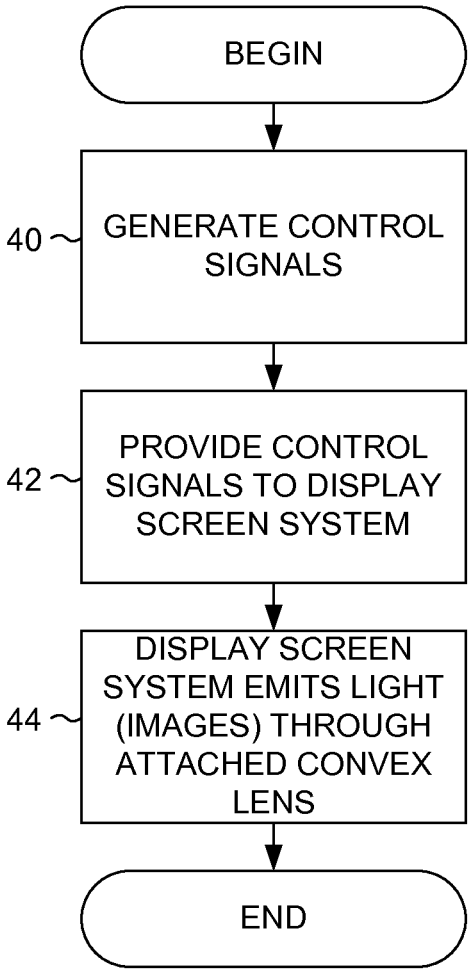
FIG. 10 is a flow diagram illustrating a method of operation of the artificial eye system elements of FIGS. 1-9.

An exemplary method of operation, in which an eye and its movement are simulated, is illustrated by the flow diagram of FIG. 10. As indicated by block 40, control signals or data representing a sequence of images simulating movement of the eye are first generated. As indicated by block 42, the data is provided to display screen system 14 (FIGS. 1-4). For example, image data 38 can be stored in memory 28. As indicated by block 44, display screen system 14 responds to the control signals or data by emitting light, which passes through lens 16 in the direction of arrow 24 (FIGS. 1-3). The light defines or reflects the sequence of images, which simulate movement of the eye from the perspective of a human observer. To an observer looking at the convex surface of the lens 16, the lens appears as an eye characterized by realistic eye movement. In embodiments in which display screen 14 (FIG. 4) includes an OLED display screen, the high contrast ratio and attendant deep blacks can help provide a startlingly realistic appearance.

While one or more embodiments of the invention have been described as illustrative of or examples of the invention, it will be apparent to those of ordinary skill in the art that other embodiments are possible that are within the scope of the invention. Accordingly, the scope of the invention is not to be limited by such embodiments but rather is determined by the appended claims.

What is claimed is:

1. A figure having an artificial eye system, comprising:

a figure body portion;

a display screen system mounted to the figure body portion, the display screen system configured to render a pixel-based image, the display screen system having a surface facing in a direction generally away from the figure body portion; and a convex lens mounted substantially in contact with the display screen system to simulate an eye of the figure; and an index-matching adhesive layer between the display screen system and the convex lens, wherein an index of refraction of the index-matching adhesive layer is substantially the same as an index of refraction of the convex lens.

2. The figure claimed in claim 1, wherein:

the surface of the display screen system is convex; and the convex lens is a meniscus lens having a convex outer surface and a concave inner surface, and the concave inner surface of the meniscus lens is attached to the convex surface of the display screen.

3. The figure claimed in claim 2, wherein:

the display screen system includes a light conduit having a proximal end and a convex distal end; and the concave inner surface of the meniscus lens is attached to the convex distal end of the light conduit.

4. The figure claimed in claim 3, wherein the index-matching adhesive layer between the concave inner surface of the meniscus lens and the convex distal end of the light conduit.

5. The figure claimed in claim 3, further comprising an index-matching adhesive layer between the proximal end of the light conduit and a display screen of the display screen system.

6. The figure claimed in claim 1, wherein the display screen system comprises:

a support structure having a convex surface; and a flexible display attached to the support structure and flexed to conform to the convex surface of the support structure.

7. The figure claimed in claim 6, wherein the convex lens is a meniscus lens having a convex outer surface and a concave inner surface, and the concave inner surface of the meniscus lens is attached to a surface of the flexible display.

8. The figure claimed in claim 7, wherein the index-matching adhesive layer between the surface of the flexible display and the concave inner surface of the meniscus lens.

9. The figure claimed in claim 1, wherein the display screen system comprises an organic light-emitting diode (OLED) display.

10. The figured claimed in claim 1, wherein the display screen system comprises a transmissive display that emits light in the direction generally away from the figure body portion.

11. The figure claimed in claim 1, further comprising an electronic controller providing control signals to the display screen system, the control signals representing a sequence of images simulating movement of the eye.

* * * * *